US009731152B2

(12) United States Patent
Swartz, IV

(10) Patent No.: US 9,731,152 B2
(45) Date of Patent: Aug. 15, 2017

(54) ACCESSORY ATTACHMENTS FOR A WELDING GARMENT

(75) Inventor: John A. Swartz, IV, Hartford, WI (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 1779 days.

(21) Appl. No.: 11/740,814

(22) Filed: Apr. 26, 2007

(65) Prior Publication Data

US 2008/0098503 A1 May 1, 2008

Related U.S. Application Data

(60) Provisional application No. 60/854,905, filed on Oct. 27, 2006.

(51) Int. Cl.

| | |
|---|---|
| ***A41D 13/04*** | (2006.01) |
| ***A41D 13/00*** | (2006.01) |
| ***A62B 17/00*** | (2006.01) |

(52) U.S. Cl.

CPC ..... *A62B 17/003* (2013.01); *A41D 13/00* (2013.01); *A41D 13/04* (2013.01); *A41D 2400/70* (2013.01); *A41D 2600/202* (2013.01)

(58) Field of Classification Search

CPC .. A41D 13/00; A41D 13/04; A41D 2600/202; A41D 13/0002; A41D 13/02; A41D 31/0022

USPC ..... 2/23, 46, 47, 48, 50, 51, 458, 81, 119, 2/122, 911, 85, 93, 2.5, 69

See application file for complete search history.

(56) References Cited

U.S. PATENT DOCUMENTS

| | | | | | |
|---|---|---|---|---|---|
| 187,405 | A | * | 2/1877 | Moulton | 2/108 |
| 380,576 | A | * | 4/1888 | Ives | 2/51 |
| 1,068,976 | A | * | 7/1913 | Buckler | 2/75 |
| 1,165,538 | A | * | 12/1915 | Pellant | 2/51 |
| 1,193,545 | A | * | 8/1916 | Hart | 2/51 |
| 2,388,234 | A | * | 11/1945 | Abel | 2/51 |
| 2,389,152 | A | * | 11/1945 | Keeler et al. | 2/458 |
| 3,691,564 | A | * | 9/1972 | La Marre et al. | 2/458 |

(Continued)

FOREIGN PATENT DOCUMENTS

GB 2011244 * 7/1979

OTHER PUBLICATIONS

Westex Inc.; Indura Ultra Soft Flame Resistant Fabrics; Protection . . . Comfort . . . Value; www.westexinc.com; pp. 1-17.

(Continued)

*Primary Examiner* — Bobby Muromoto, Jr.

(74) *Attorney, Agent, or Firm* — Fletcher Yoder P.C.

(57) ABSTRACT

A flame resistant garment, in certain embodiments, may include multiple garment portions to provide different degrees of protection for welding or another application. In one embodiment, the flame-resistant garment may include a base garment and one or more supplemental protective layers or garments. For example, the base garment may include a jacket, a vest, a coverall, a jumpsuit, an overall, pants, trousers, a smock, a hat, a hood, or a combination thereof. The protective layer may include a bib or any other suitable attachment to add further flame resistance. Further, the multiple garment portions may be coupled together via a snap fastener system, a hook-and-loop system, a button system, a zipper system, a buckle system, or a clip system, or a combination thereof.

15 Claims, 9 Drawing Sheets

(56) References Cited

U.S. PATENT DOCUMENTS

| | | | | |
|---|---|---|---|---|
| 3,961,376 | A * | 6/1976 | Howell | 2/71 |
| 4,890,336 | A * | 1/1990 | Worton | 2/79 |
| 4,999,850 | A * | 3/1991 | Grilliot et al. | 2/126 |
| 5,727,401 | A * | 3/1998 | Statham | 66/176 |
| 2006/0277651 | A1* | 12/2006 | Razzaghi et al. | 2/81 |
| 2007/0094763 | A1* | 5/2007 | Silver | 2/69 |
| 2007/0245443 | A1* | 10/2007 | Vereen | 2/69 |

OTHER PUBLICATIONS

Westex Inc.; Naturally Static Dissipative; Comfort of Cotton; www.westexinc.com; pp. 18-20.
Westex Inc.; Indura Ultra Soft Flame Resistant Fabrics with EPIC by Nextec; Outsmart the Outdoors; www.westexinc.com; 4 pages.
Westex Inc.; VINEX; Protective Fabrics for the Aluminum Industry; www.westexinc.com; 4 pages.
DuPont NOMEX; NOMEX AP: Engineered for Superior ARC Protection; Perform When the Heat's On; www.personalprotection.dupont.com; 4 pages.
DuPont Protera; Product Specification Sheet; www.personalprotection.dupont.com; 2 pages.
DuPont; What is KEVLAR?; www.dupont.com/kevlar/whatiskevlar/whatiskevlar_main.html; 2 pages.
CHAPMAN Innovations; CARBON X; www.chapmaninnovations.com/products/carbonx.php; 2 pages.
Personal Leather Apparel; Introducing the FLAMEGUARD A2 "heritage meets technology"; Perrone Fire Retardant Goatskin Leather; www.perroneleather.com; 1 page.
Westex Inc.; Valzon Flame Resistant Knit Fabrics; www.westexinc.com/valzon.htm; 2 pages.

* cited by examiner

ACCESSORY ATTACHMENTS FOR A WELDING GARMENT

CROSS REFERENCE TO RELATED APPLICATIONS

This application claims priority to U.S. Provisional Patent Application No. 60/854,905, entitled "ACCESSORY ATTACHMENTS FOR A WELDING JACKET", filed on Oct. 27, 2006.

BACKGROUND

The invention relates generally to a welding garment. More specifically, the invention relates to a flame-resistant welding garment, such as a welding jacket or another article of clothing, configured to receive a supplemental flame-resistant protective layer or other accessory attachments.

Welding garments are typically a one-piece garment, which can be bulky and likely to retain body heat. If the welding garment is not worn by an operator, then the heat, sparks, or molten metal associated with a welding procedure may injure the operator due to a lack of flame resistance of normal clothing. However, in many facilities and applications, the operator may perform welding procedures intermittently rather than continuously throughout the day. Thus, the welding garment is not continuously needed for protection. Welding procedures often occur in uncontrollable, unpredictable, or extreme weather conditions, for example, high temperature and high humidity. These weather conditions can make the existing welding garments uncomfortable or unbearable to wear. As a result, the operator may be inclined to perform the welding procedures without the proper welding garment. In addition, if the welding garment becomes overly worn, damaged, or ineffective to protect against the welding conditions, then the entire welding garment is typically replaced at a significant cost.

BRIEF DESCRIPTION

A flame resistant garment, in certain embodiments, may include multiple garment portions to provide different degrees of protection for welding or another application. In one embodiment, the flame-resistant garment may include a base garment and one or more supplemental protective layers or garments. For example, the base garment may include a jacket, a vest, a coverall, a jumpsuit, an overall, pants, trousers, a smock, a hat, a hood, or a combination thereof. The protective layer may include a bib or any other suitable attachment to add further flame resistance. Further, the multiple garment portions may be coupled together via a snap fastener system, a hook-and-loop system, a button system, a zipper system, a buckle system, or a clip system, or a combination thereof.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Various embodiments of a welding garment are disclosed that provide flame-resistant protection to a wearer. The garment may include a flame-resistant article of clothing that is configured to receive a protective layer of clothing via a fastening mechanism. The article of clothing may include a jacket, a vest, a coverall, a jumpsuit, an overall, pants, trousers, smock, a hat, a hood, or a combination thereof. The protective layer of clothing may include a bib or other accessory attachments. The accessory attachments provide for modularity or layering of flame-resistant material, thereby enabling the wearer to increase or decrease flame-resistant layers as desired. This is beneficial because it enables the operator to customize flame-resistant protection from one application to the next.

For example, in one of the contemplated embodiments, the article of clothing is a welding jacket that includes a top section and a bottom section that may be made from the same or different flame-resistant materials. In a first operation, the wearer might be engaged in an over-head welding operation, thereby exposing his or her upper body to the heat intensive operation. Therefore, the wearer may desire more protection for the shoulder area during this operation as compared to a lower level welding operation, e.g., at a bench or in a bent over position.

Additionally, the multi-layered system enables the user to wear the article of clothing in a fitted manner which may be more comfortable than a standard protective garment that only provides "one size fits all" protection. Finally, embodiments of the present invention reduce the cost of flame-resistant protection by enabling the user to replace worn or abraded accessory attachments without having to replace the entire article of clothing. This may also reduce the initial cost of the article of clothing by enabling the substitution of a less expensive material given it may only need to serve as a redundant layer to the attached accessory. Therefore, the article of clothing may not only be less expensive but may also be made from a lighter weight material to provide additional comfort for the wearer when he/she is not engaged in a welding operation.

Figure 1:
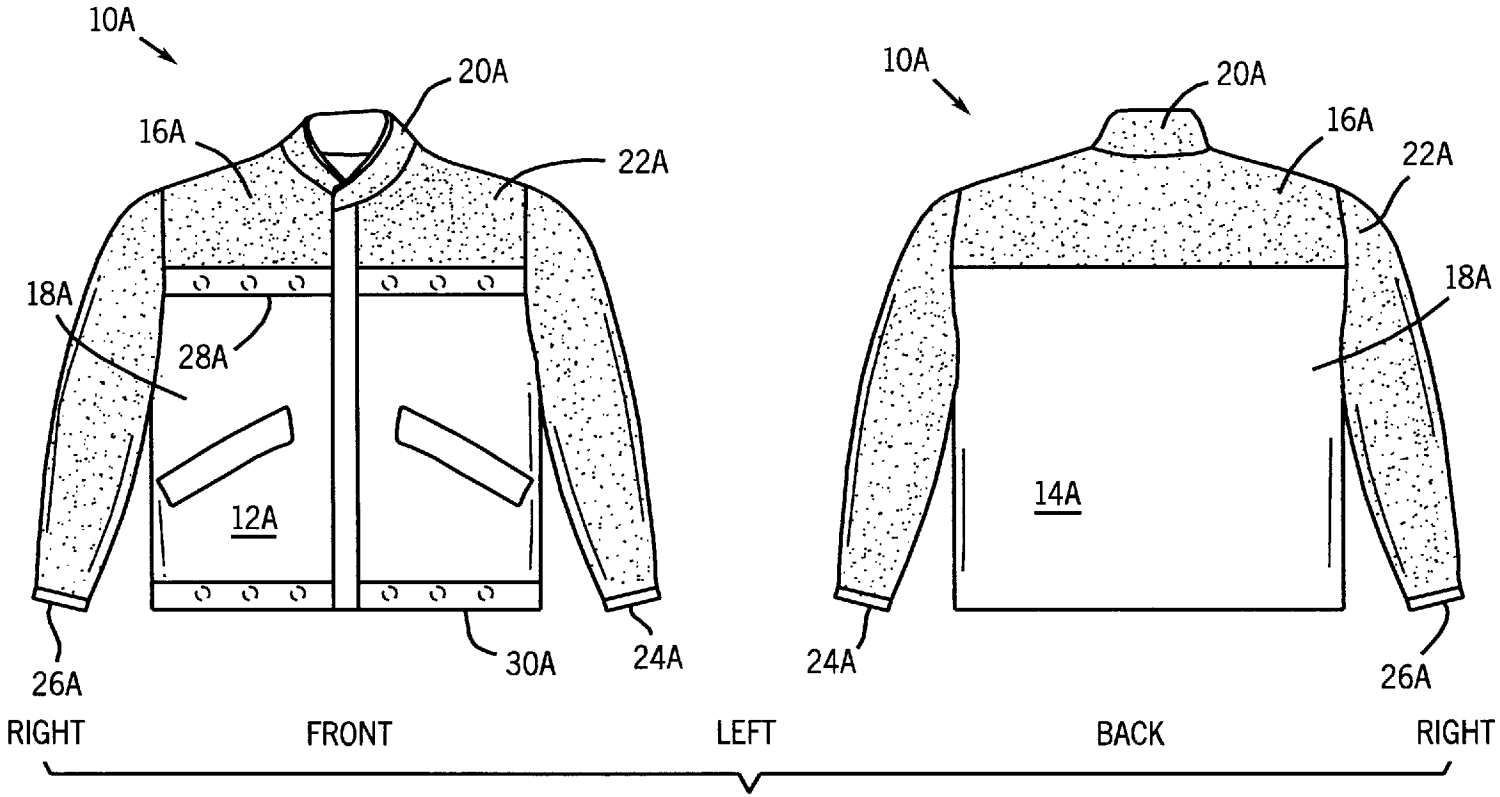
FIG. 1 illustrates a front elevational view and a back elevational view of an embodiment of a flame-resistant article of clothing, wherein the clothing includes a jacket having upper and lower portions made from first and second materials, respectively.

Turning now to the drawings, FIG. 1 illustrates a front view 12A and a back view 14A of a flame-resistant article of clothing in the form of jacket 10A. Welding jacket 10A may be made from any number of materials, including leather, in whole or in part. Additionally, welding jacket may be made from flame-resistant materials that may include a chemically treated natural fabric, a chemically treated natural fabric and synthetic fiber blend, a flame-resistant synthetic fiber blend, a flame-resistant leather, or a combination thereof.

Welding jacket 10A includes a top section or upper portion 16A and a bottom section or lower portion 18A. Top section 16A includes a collar 20A, shoulder area 22A, a left sleeve 24, and a right sleeve 26. The top section 16A terminates at a first bottom edge or upper attachment area 28A. Bottom section 18A substantially covers the torso of the wearer and terminates in a second bottom edge or lower attachment area 30A. Lower attachment area 30A may be located at or below the waist of the person wearing the jacket, when the jacket is worn. In the illustrated embodiment shown in FIG. 1, top section 16A may be made of leather and bottom section 18A may be made of a flame-resistant cotton fabric or any other suitable material. Jacket 10A may be worn by the wearer in a standard fashion, and has a vertical zipper or vertical array of buttons that crosses the top section 16A and bottom section 18A to enable opening or closing of jacket 10A about the wearer. Additionally, collar 20A may include a number of different configurations, such as a barracuda style or square edged turned down style.

Figure 2:
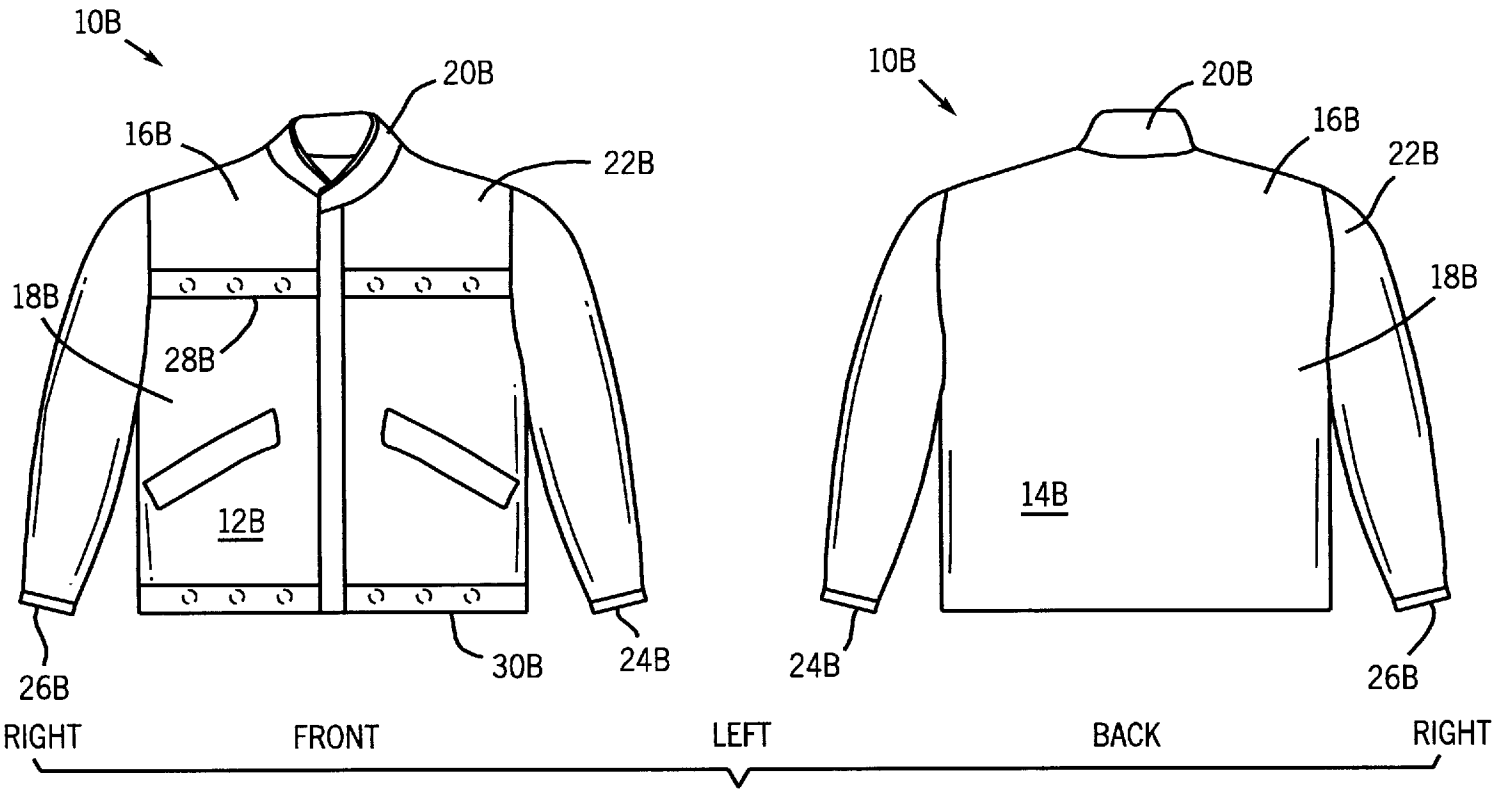
FIG. 2 illustrates a front elevational view and a back elevational view of an alternate embodiment of the jacket shown in FIG. 1.

FIG. 2 illustrates a front view 12B and a back view 14B of an alternate embodiment of a welding jacket 10B. Welding jacket 10B includes a top section 16B, a bottom section 18B, a collar 20B, a shoulder area 22B, a left sleeve 24B, a right sleeve 26B, a first bottom edge 28B, and a second bottom edge 30B. Additionally, jacket 10B may include a hat or hood attached at or near collar 20B. In the embodiment of FIG. 2, top section 16B and bottom section 18B are made from a single flame-resistant material, such as a flame-resistant cotton fabric, that is suitable for jacket 10B. Alternatively, as discussed with the embodiment illustrated in FIG. 1, top section 16B and bottom section 18B may include more than one flame-resistant material.

Specifically, the top section 16B, the bottom section 18B, or both, may be made of a flame-resistant material including a cotton fabric impregnated with a flame retardant chemical; a vinal and polynosic rayon blend; an aramid synthetic fiber; a meta-aramid and para-aramid fiber blend; a meta-aramid, para-aramid, and modacrylic fiber blend; an oxidized polyacrylonitrile and aramid fiber blend; or a combination thereof. An exemplary embodiment of a cotton fabric impregnated with a flame retardant chemical is available from Westex Inc. in Chicago, Ill., and may be identified under the trademark INDURA. An exemplary embodiment of a cotton and high tenacity nylon fabric blend impregnated with a flame retardant chemical is also available from Westex Inc. and may be identified under the trademark INDURA Ultra Soft. Finally, Westex also provides an exemplary embodiment of a vinal and polynosic rayon blend that may be identified under the trademark Vinex.

Additionally, an exemplary embodiment of an aramid synthetic fiber is available from DuPont in Richmond, Va., and may be identified under the trademark NOMEX. An exemplary embodiment of a meta-aramid and para-aramid fiber blend is also available from DuPont and may be identified under the trademark NOMEX IIIA. DuPont also provides an exemplary embodiment of a meta-aramid, para-aramid, and modacrylic fiber blend that may be identified under the trademark Protera. Finally, an exemplary embodiment of an oxidized polyacrylonitrile and aramid fiber blend is available from Chapman Thermal Products in Salt Lake City, Utah, and may be identified under the trademark CarbonX. It should be noted that even though specific example of different materials have been disclosed, embodiments of the present invention are by no means limited to these materials and may include any suitable flame-resistant material. For example, the flame-resistant material may include leather, such as pigskin or goatskin leather.

Figure 3:
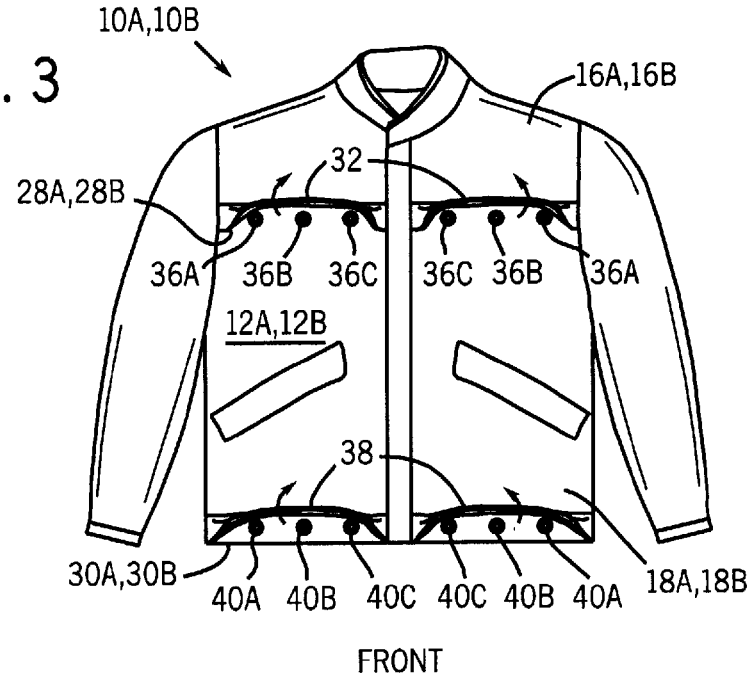
FIG. 3 is a front elevational view of an embodiment of the jacket shown in FIGS. 1 and 2, further illustrating a fastening mechanism located at an upper attachment area and a lower attachment area.

In the following figures, the alphabetic characters "A" and "B" of similar items illustrated and described with reference to FIGS. 1 and 2 are shown in the figures, yet the following discussion excludes these characters for simplicity. Thus, only the numeric portion of each item is referenced in the following discussion. FIG. 3 illustrates another front view 12 of the jacket 10 shown in FIGS. 1 and 2, further illustrating a fastening mechanism located at an upper attachment area and a lower attachment area. As with the previous figures, FIG. 3 illustrates jacket 10 having top section 16 and bottom section 18. Flame-resistant layers or flaps 32 and 38 are located at first bottom edge 28 and second bottom edge 30, respectively. Flaps 32, 38 may be lifted to expose a fastening mechanism located on jacket 10. Further, flaps 32, 38 are made from a flame-resistant material and provide a protective layer to cover the fastening mechanism. For example, flaps 32, 38 protect the fastening mechanism from molten metal, sparks, or BB's originating from a weld location during a welding procedure.

Specifically, one of the contemplated embodiments of the flame-resistant garment includes male snaps 36A, 36B, 36C, 40A, 40B, and 40C as the fastening mechanism. Thus, flaps 32, 38 helps to prevent the male snaps from becoming damaged or made inoperable as a result of refracted material that may lodge within the snaps and/or melt the snaps. Additionally, the present embodiments are not limited to snaps, and flaps 32,38 may provide protection for various fastening mechanisms. For example, the fastening mechanisms may include a hook-and-loop system, a button system, a zipper system, a buckle system, a clip system, a snap fastener system, or a combination system thereof.

Figure 4:
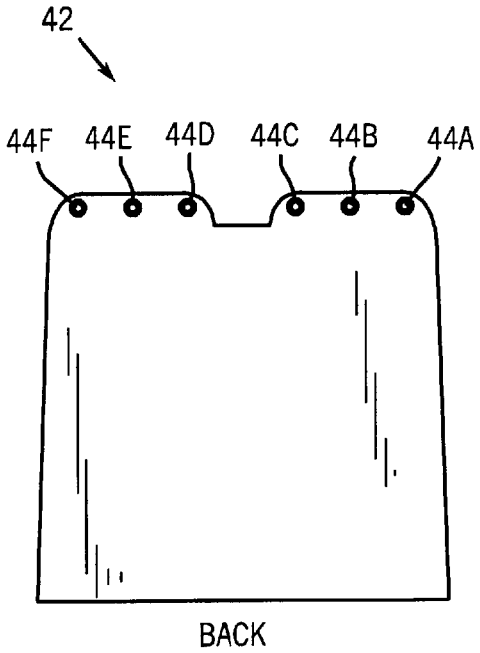
FIG. 4 is a back elevational view of an embodiment of a flame-resistant protective layer of clothing, such as a bib, configured to couple with the jacket shown in FIGS. 1-3.

FIG. 4 is a back view of an embodiment of a flame-resistant protective layer of clothing or protective garment 42 in the form of a bib. Bib 42 is an accessory attachment having an attachment mechanism located along a top periphery of the bib. In one of the contemplated embodiments, the attachment mechanism includes female snaps 44A, 44B, 44C, 44D, 44E, and 44F. Female snaps 44A, 44B, and 44C are separated or spaced apart so that they mate with male snaps 36A, 36B, 36C, located on the right side of top section 16 of jacket 10. Similarly, female snaps 44D, 44E, and 44F are separated or spaced apart so that they mate with male snaps 36A, 36B, 36C, located on the left side of top section 16 of jacket 10. Bib accessory 42 may be sized to substantially or entirely cover jacket 10 about the torso of the wearer when attached to the jacket at this location. Finally, male snaps 40A, 40B, 40C may be spaced similar to male snaps 36A, 36B, and 36C, such that bib 42 can be attached at this location of jacket 10.

Figure 5A:
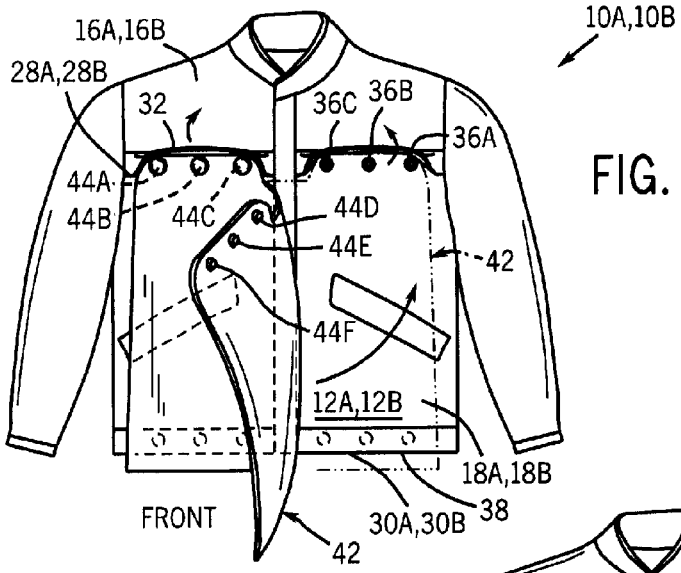
FIG. 5A illustrates the bib of FIG. 4 removably attached to the jacket of FIGS. 1-3 at the upper attachment area.
Figure 5B:
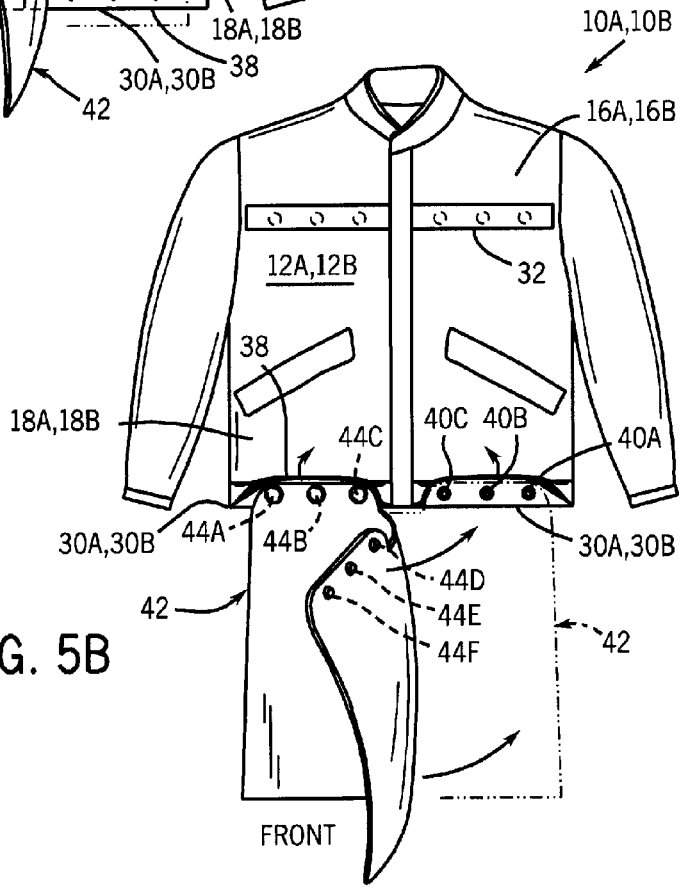
FIG. 5B illustrates the bib of FIG. 4 removably attached to the jacket of FIGS. 1-3 at the lower attachment area.

FIG. 5A illustrates bib 42 partially attached to the right side of jacket 10 at upper attachment area 28. The figure shows flaps 32 lifted to expose the fastening mechanism thereby enabling bib 42 to be removably attached to jacket 10. Similarly, FIG. 5B illustrates bib 42 partially attached to the right side of jacket 10 at the lower attachment area 30. As illustrated in FIG. 5B, male snaps 40A, 40B and 40C are equally spaced to align with female snaps 44A, 44B, and 44C. Further, accessory attachment 42 may be sized to substantially or entirely cover the waste area and a portion of the legs down to the shin of the wearer. Finally, jacket 10 enables the wearer to use more than one protective garment or bib by including both upper attachment area 28 and lower attachment area 30 that enables simultaneous attachment of two separate welding accessories 42. Alternatively, the bib 42 may attach to both the upper and lower attachment areas 28, 30. Furthermore, the bib 42 may extend entirely or partially along the pants of a wearer, around the body of the wearer, or over the shoulders to cover the front and back of a wearer, or a combination thereof.

Figure 6:
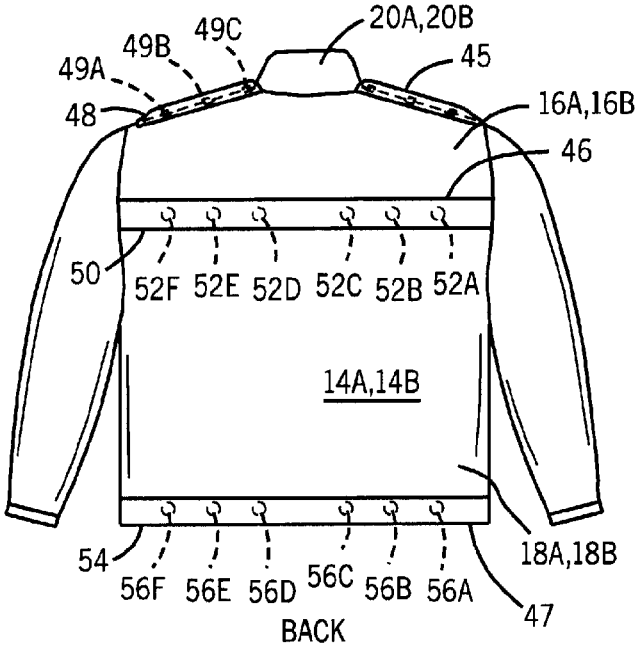
FIG. 6 is a back elevational view of an alternate embodiment of the jacket of FIG. 1, wherein the jacket includes a shoulder attachment region, a mid-back attachment region, and a lower waist-line attachment region.

FIG. 6 is a back view 14 of an alternate embodiment of the jacket 10 having a shoulder attachment region 45, a mid-back attachment region 46, and a waist-line attachment region 47. In this embodiment, the jacket 10 includes top section 16, bottom section 18, and collar 20. Further, the jacket 10 includes flaps 48 located at shoulder attachment region 45 that provide a flame-resistant protective layer to cover fastening mechanisms 49A, 49B, and 49C. The jacket 10 similarly includes a flap 50 and fastening mechanisms 52A, 52B, 52C, 52D, 52E, 52F located at mid-back attachment region 46. Additionally, the jacket may include flap 54 as well as fastening mechanism 56A, 56B, 56C, 56D, 56E, and 56F located at waist-line attachment region 47. As with the previous embodiments, flaps 48, 50, and 54 may include a flame-resistant layer to cover and protect the fastening mechanisms. FIG. 6 further illustrates male snaps as the fastening mechanism. However, embodiments of the present invention are by no means limited to a snap fastener system. As with the embodiments discussed above, fastening mechanisms 49, 52, and 56 may include a hook-and-loop system, a button system, a zipper system, a buckle system, a clip system, or a combination thereof.

Figure 7:
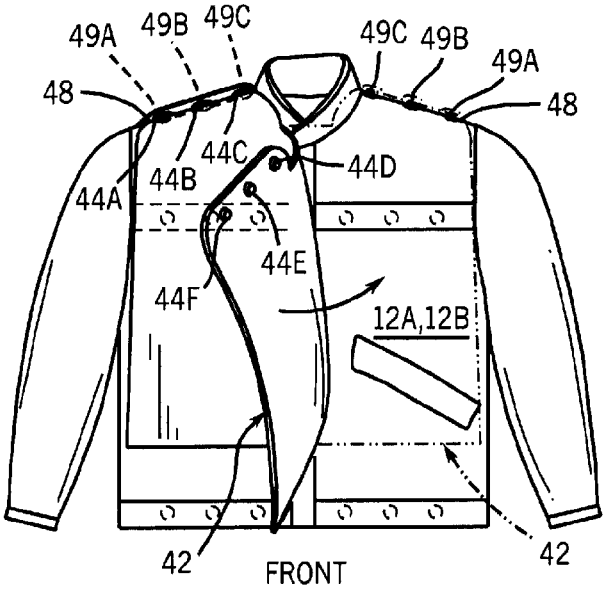
FIG. 7 illustrates the bib of FIG. 4 removably attached to the jacket of FIG. 6 at the shoulder attachment region.

FIG. 7 illustrates bib 42 partially attached to the right side of jacket 10 at shoulder attachment region 45. The figure shows flap 48 lifted to expose the fastening mechanism thereby enabling bib 42 to be removably attached to the jacket 10. Female snaps 44A, 44B, and 44C are separated or spaced apart so that they mate with male snaps 49A, 49B, and 49C located on the right side of the jacket. Similarly, female snaps 44D, 44E, and 44F are separated or spaced apart so that they mate with male snaps 49A, 49B, 49C, located on the left side of the jacket. Bib accessory 42 may be sized to substantially or entirely cover the shoulder region and upper torso of the wearer. This may be especially beneficial in over head welding applications. Additionally, male snaps 52A-52F and 56A-56F may be spaced similar to female snaps 44A-44F, such that bib 42 may be attached at either of these locations of jacket 10. Again, multiple fastening mechanisms enable the attachment of multiple welding accessories providing the wearer with the flexibility of multi-layering the flame-resistant garment. In some embodiments, a first protective layer may be coupled to the jacket 10 at the region 45, a second protective layer may be coupled to the jacket 10 at the region 46, and a third protective layer may be coupled to the jacket 10 at the region 47, These protective layers on the back of the jacket 10 also may be in addition to one or more protective layers coupled to the front of the jacket 10 at areas 28 and 30, as discussed in detail above.

Figure 8:
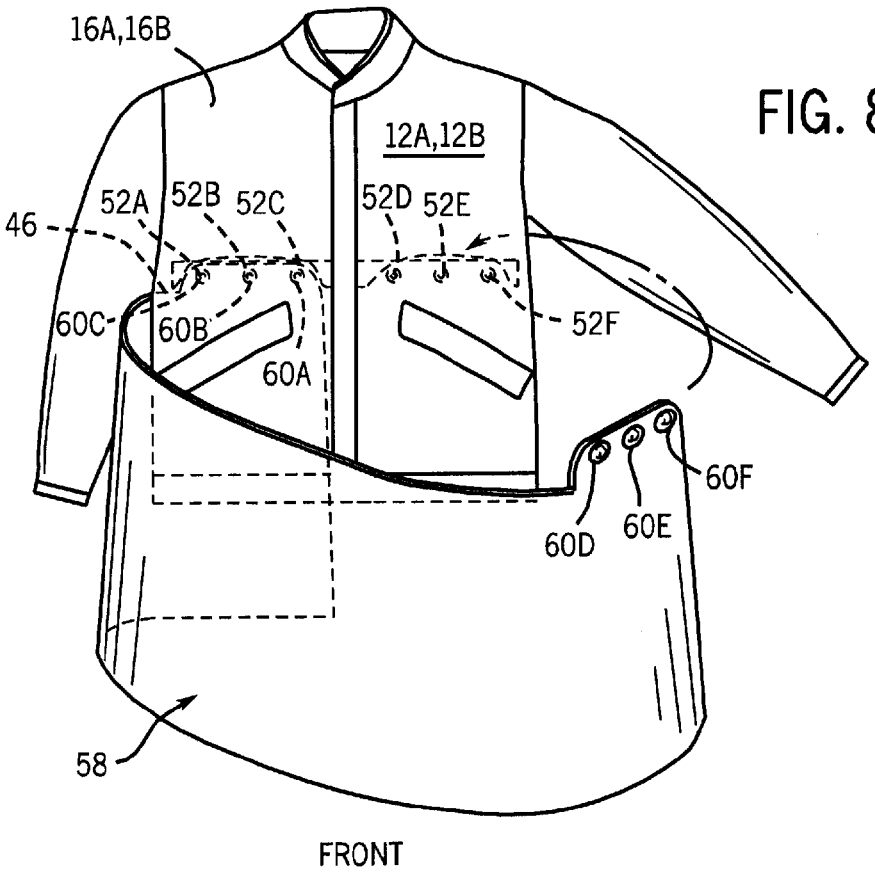
FIG. 8 illustrates an alternate embodiment of a bib removably attached to the jacket of FIG. 6 at the mid-back attachment region, wherein the bib wraps around the entire lower portion of the jacket.

FIG. 8 illustrates an alternate bib 58 partially attached to the jacket 10 of FIG. 6 at the mid-back attachment region 46. The figure illustrates bib 58 wrapping around the entire lower portion of the jacket 10. In this embodiment, alternate bib 58 includes attachment mechanisms 60A, 60B, 60C, 60D, 60E, and 60F arranged in a similar configuration to that of bib 42. Bib 58 is attached to the mid-back attachment region 46 of the jacket 10 via male snaps 52A, 52B, 52C, 52D, 52E, and 52F. In the figure, bib 58 is partially attached to the right side of the jacket with female snaps 60A, 60B, and 60C coupled to male snaps 52A, 52B, and 52C. The figure further illustrates bib 58 extending from the back right side of the jacket around to the front side of the jacket, and further around to the back left side of the jacket were the bib may be attached thereto. In this embodiment, the bib provides 360 degree protection to a user as illustrated by the figure.

Figure 9A:
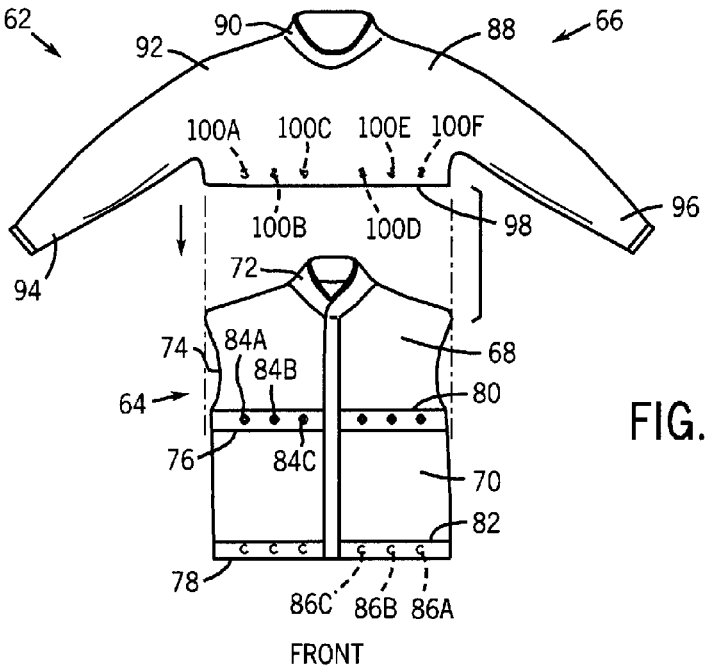
FIG. 9A is an alternate embodiment of a jacket system illustrating a smock and a vest configuration.

FIG. 9A illustrate a front view of an alternate embodiment of a jacket system 62 that includes a sleeveless vest 64 and a sleeved bib or smock 66. Sleeveless vest 64 includes a top section 68, bottom section 70, collar 72, and sleeveless shoulder area 74. Top section 68 includes collar 72 and shoulder area 74, and terminates at a first bottom edge or upper attachment area 76. Bottom section 70 extends from first bottom edge 76 and terminates at a second bottom edge or lower attachment area 78. Bottom section 70 may be sized to substantially or entirely cover the lower torso of the wearer.

Similarly to the previous embodiments, a top flap 80 and a bottom flap 82 are located at first bottom edge 76 and second bottom edge 78, respectively. Top flap 80 and bottom flap 82 are made from a flame-resistant layer that covers and protects a top fastening mechanism 84A, 84B, and 84C and a bottom fastening mechanism 86A, 86B, and 86C. These mechanisms are located on both the left and right side of the jacket 10. Additionally, the figure illustrates male snaps for the fastening mechanism, but as discussed above, the fastening mechanism is not limited to a snap fastener system.

FIG. 9A also illustrates front view 88 of the sleeved bib or smock 66. A smock may be defined as loose outer garment that protects a layer of clothes or other garment. Sleeved bib or smock 66 includes collar 90, shoulder area 92, right sleeve 94, and left sleeve 84. Sleeved bib 66 extends from the collar 90 to a bottom edge 98. Attachment mechanisms 100A, 100B, 100C, 100D, 100E, and 100F are located near the bottom portion 98 of sleeved bib 66. Both sleeved bib 66 and vest 64 may be made from any of the flame-resistant materials discussed above or any other suitable material.

Figure 9B:
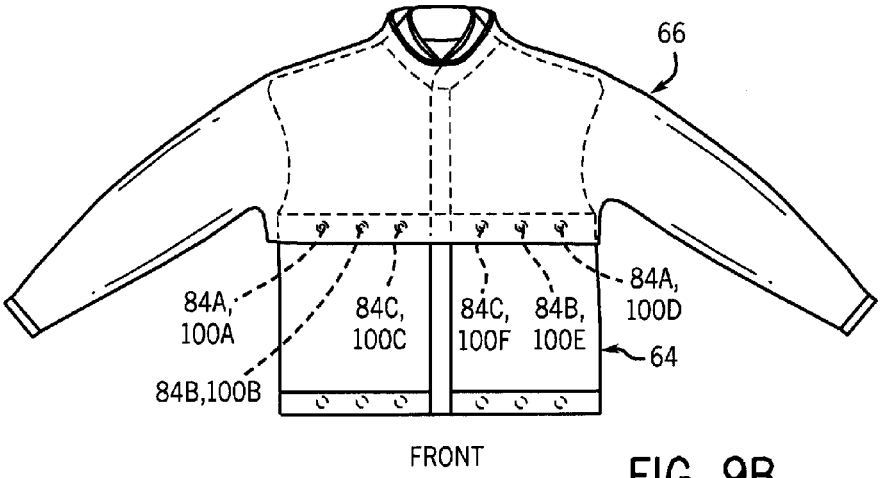
FIG. 9B shows the jacket system of FIG. 9A, illustrating the smock attached to the vest.

FIG. 9B illustrates the welding jacket system of 9A with the sleeved bib 66 attached to the sleeveless vest 64. The sleeved bib 66 is attached via the attachment mechanisms 100A-100F coupled to the fastening mechanisms 84A, 84B, and 84C located on both the left and right side of sleeveless vest 64. Additional fastening and attachment mechanisms may also be included to further removably attach bib 66 to vest 64. In this embodiment, sleeveless vest 64 or sleeved bib 66 can be made from similar materials or they may be made from different materials. For example, the vest 64 may be made of a first flame resistant material, and the vest 66 may be made of a second flame resistant material. The first and second flame resistant materials may be the same or different from one another. In addition, one or more protective layers, made of the same or different materials, may be coupled to the vest 64 via the attachment mechanisms 84 and/or 88 with or without the bib 66.

In some embodiments, sleeveless vest 64 can be made from a lightweight flame-resistant material, whereas sleeved bib 66 can be made from a heavier more abrasion resistant material. This embodiment may be particularly useful for overhead welding procedures, which can result in molten metal, sparks, and BB's dropping onto the shoulder area 92 of the wearer. Further, this embodiment may be particularly useful in warmer climates enabling the user to remove the sleeved bib 66 and use the vest 64 alone or in combination with other protective layers. Additionally, jacket system 62 enables the owner to replace sleeved bib 66 or the vest 64 without requiring the replacement of the entire jacket system 62. This may be beneficial in situations where sleeved bib 66 takes the brunt of normal everyday wear and tear. Finally, sleeveless vest 64 may be made from various flame resistant fabrics and may even be in the form of a light weight flame-resistant shirt.

Figure 10:
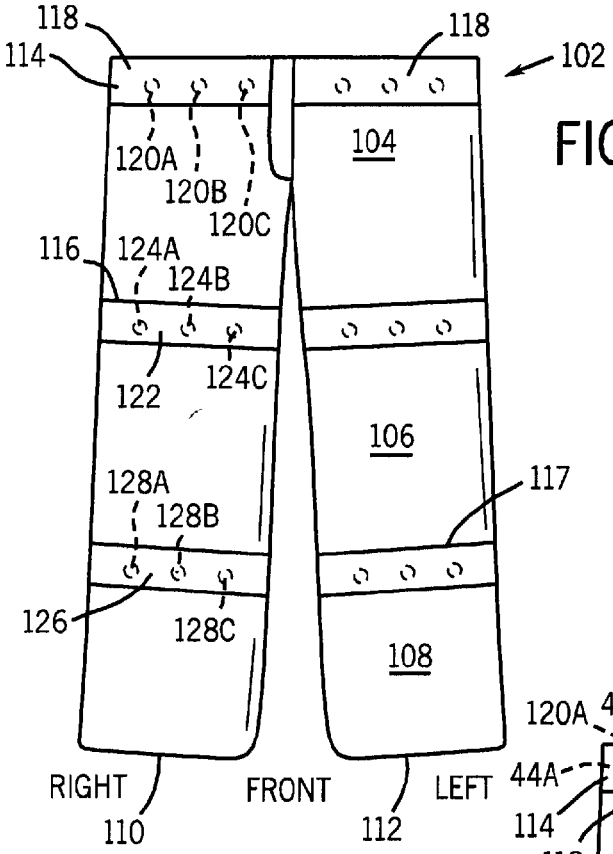
FIG. 10 illustrates a front elevational view of an alternate embodiment of a flame-resistant article of clothing, wherein the clothing includes pants having a waist attachment section, a mid-thigh section, and a shin section.

FIG. 10 illustrates a front view of an alternate embodiment of a flame-resistant article of clothing in the form of pants or trousers 102. Pants 102 include a waist section 104, mid-thigh section 106, shin section 108, right leg 110, and left leg 112. Waist section 104 extends from a top edge 114 to a first edge 116. Mid-thigh section 106 extends from the first edge 116 to a second edge 117. Likewise, shin section 108 extends from second edge 117 to the end of the pants 102.

As with the other flame resistant articles of clothing, pants 102 may include a number of flame-resistant layers or flaps. Flap 118 is located on top edge 114 and provides a flame-resistant protective layer to cover male snaps 120A, 120B, and 120C. Similarly, flap 122 is located at first edge 116 and provides a flame-resistant protective layer to cover male snaps 124A, 124B, and 124C. Further, flap 126 is located at second edge 117 and provides a flame-resistant protective layer to cover male snaps 128A, 128B, and 128C. In one of the contemplated embodiments, waist section 104, mid-thigh section 106, and shin section 108 may be made from similar or different materials. These may include any of the flame-resistant discussed above or any other suitable material.

Figure 11:
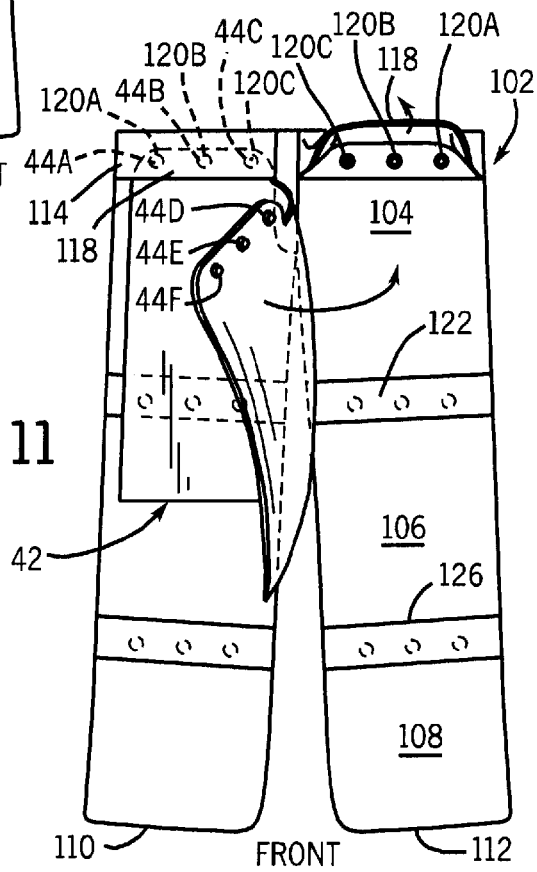
FIG. 11 illustrates the bib of FIG. 4 removably attached to the pants of FIG. 10 at the waist attachment section.

FIG. 11 illustrates bib 42 partially attached to the right side of pants 102 to cover waist region 104 and a portion of mid-thigh region 106. As illustrated, flap 118 may be lifted to expose fastening mechanisms 120A, 120B, and 120C. Attachment mechanism 44A, 44B, and 44C may then be coupled to fastening mechanisms 120A, 120B, and 120C. In this particular configuration bib 42 provides an additional flame-resistant layer for waist section 104 and mid-thigh section 106. This configuration may be particularly useful for a welding application where the user is in a sitting position, such as at a bench, and the user would like to obtain additional protection to these sections.

Further, bib 42 may also be attached at first edge 116 or second edge 117 to provide a flame-resistant layer to the entire mid-thigh section 106 and/or shin region 108. In these configurations, bib 42 attaches to the respective snaps 124A-124C and/or 128A-128C located on both the right and left side of pants 102. Additionally, a second bib or two independent bibs may be used in conjunction with first bib 42 to provide protection for each individual leg. For example, additional fastening mechanisms may be located on the back side of the pants 102 to enable the wearer to wrap and secure bib 42 around a single leg. This configuration may be particularly useful for a welding application where the user is welding in a bent over position, such as for welding installed piping, and the user would like to provide additional protection to these sections.

Figure 12:
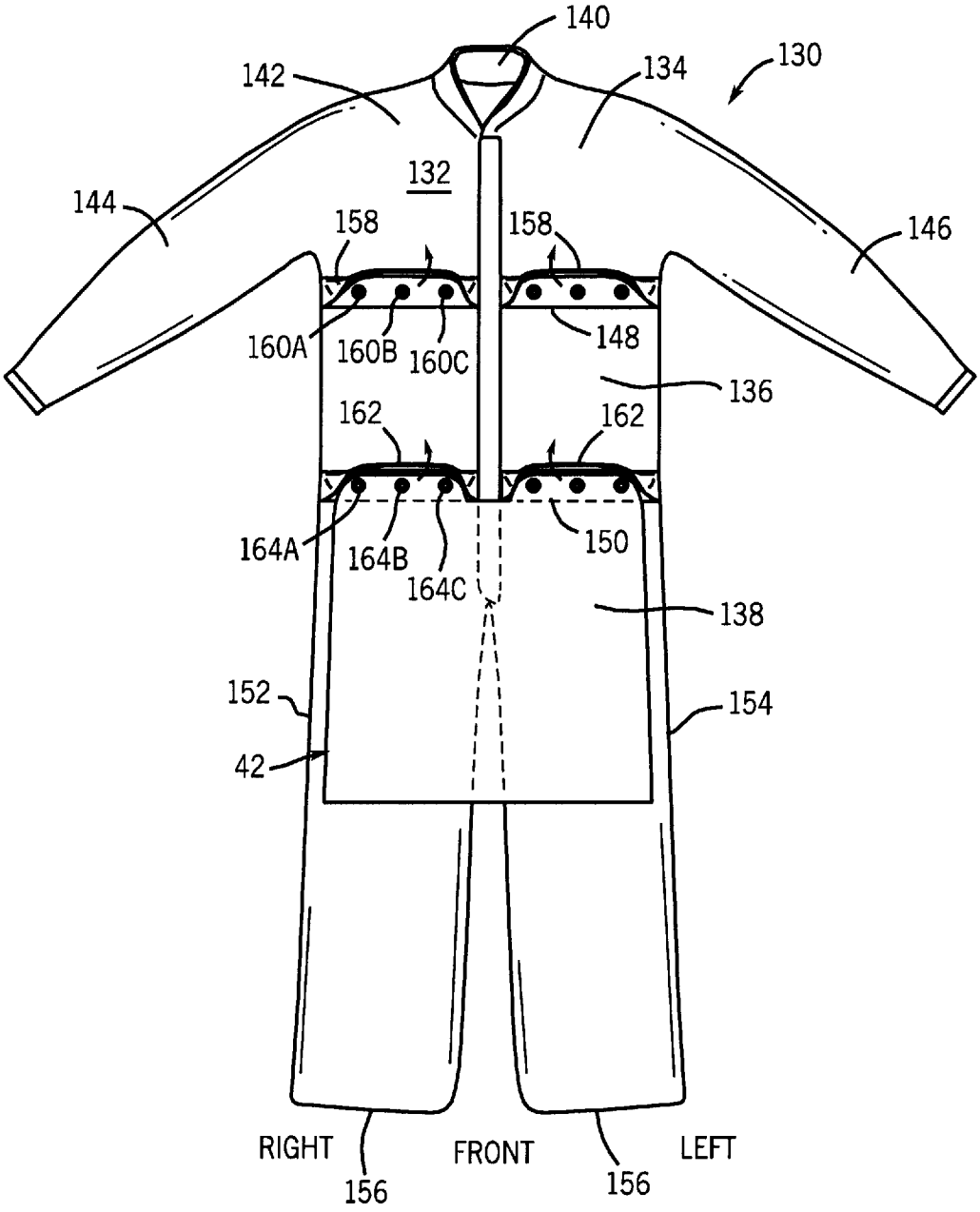
FIG. 12 illustrates a front elevational view of an alternate embodiment of a flame-resistant article of clothing, wherein the clothing includes a jumpsuit or overalls.

FIG. 12 illustrates a front view 132 of an alternate embodiment of a flame-resistant article of clothing in the form of a jumpsuit, coverall, or overalls 130. Coverall 130 includes a top section 134, bottom section 136, a leg section 138, a collar 140, shoulder area 142, left sleeve 144, and right sleeve 146. Top section 134 includes collar 140 and shoulder area 142 and terminates at a first edge 148. Bottom section 136 extends from first edge 148 to second edge 150. Leg section 138 extends from second edge 150 downward to include a right leg 152 and a left leg 154 that terminate at a third edge 156.

As with the other flame resistant articles of clothing, overall 130 may include a number of flame-resistant layers or flaps. Flap 158 is located at first edge 148 and provides a flame-resistant protective layer to cover male snaps 160A, 160B, and 160C. Similarly, flap 162 is located at second edge 150 and provides a flame-resistant protective layer to cover male snaps 164A, 164B, and 164C. In one of the contemplated embodiments, top section 134, bottom section 136, and leg section 138 may be made from similar or different materials. These materials may include any of the flame-resistant materials discussed above or any other suitable material.

FIG. 12 further illustrates bib 42 removably attached to coveralls 130 at second edge 150. As shown in the figure, flap 162 may be lifted to expose fastening mechanisms 164A, 164B, and 164C, thereby enabling attachment mechanisms 44A-44F to be coupled thereto. In this particular configuration, bib 42 provides an additional flame-resistant layer to cover the waist region and leg section 138. Further, bib 42 may also be attached to first edge 148 to provide a flame-resistant layer to cover bottom section 136 and leg section 138. Finally, coveralls 130 may include additional fastening mechanisms that enable a wearer to provide added flame-resistant protection to other areas of the garment. For example, coverall 130 could include additional fastening mechanisms similar to those illustrated in FIGS. 6 and 10, for instance, on top of the shoulder area or at different locations along right leg 152 or left leg 154. Additionally, although the figure illustrates male snaps, the fastening mechanism is not limited to a snap fastener system.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A garment, comprising:

a welding jacket that completely covers a front and a back of a torso of a wearer when worn by the wearer; and a protective layer of clothing comprising a first flame-resistant material and a fastening mechanism configured to be removably attached to a surface of the welding jacket at different positions to cover different portions of the welding jacket and the torso of the wearer; wherein the first flame-resistant material comprises a base material impregnated with a flame-retardant chemical, and the different portions are partially overlapping and partially offset from one another.

2. The garment of claim 1, wherein the welding jacket comprises a second flame-resistant material, wherein the first and second flame-resistant materials overlap one another to provide two flame-resistant layers while the protective layer of clothing is removably attached to the surface of the welding jacket.

3. The garment of claim 2, wherein the first flame resistant-material comprises a first cotton fabric impregnated with a flame retardant chemical; a first cotton and high tenacity nylon fabric blend impregnated with a flame retardant chemical; or a combination thereof, and the second flame-resistant material comprises a second cotton fabric impregnated with a flame retardant chemical; a second cotton and high tenacity nylon fabric blend impregnated with a flame retardant chemical; a vinyl and polynosic rayon blend; an aramid synthetic fiber; a meta-aramid and para-aramid fiber blend; a meta-aramid, para-aramid, and modacrylic fiber blend; an oxidized polyacrylonitrile and aramid fiber blend; a flame-resistant leather; or a combination thereof.

4. A garment, comprising:

a welding jacket, comprising:

an upper portion comprising a first flame-resistant material and an upper attachment area, wherein the upper portion comprises a collar, a shoulder area, a left sleeve, and a right sleeve, and the upper portion terminates at a bottom edge and is configured to cover an entire upper torso of a wearer;

a lower portion comprising a second flame-resistant material and a lower attachment area, wherein the lower portion abuts or overlaps the upper portion at the bottom edge, terminates at a lower edge, and is configured to cover an entire lower torso of the wearer; and a protective garment comprising a third flame-resistant material, wherein the protective garment is configured to be removably attached to the upper portion at the upper attachment area to overlap the third flame-resistant material at least substantially over the first flame resistant material, the protective garment is configured to be removably attached to the lower portion at the lower attachment area to overlap the third flame-resistant material at least substantially over the second flame resistant material while not attached to the upper attachment area, and the protective garment covers a first area of the welding jacket while removably attached to the upper portion and a second area of the welding jacket while removably attached to the lower portion, the first area is greater or lesser than the second area, and the third flame-resistant material comprises a base material impregnated with a flame-retardant chemical.

5. The garment of claim 4, wherein the first flame-resistant material, the second flame-resistant material, or a combination thereof, comprise a first cotton fabric impregnated with a flame retardant chemical; a first cotton and high tenacity nylon fabric blend impregnated with a flame retardant chemical; a vinyl and polynosic rayon blend; an aramid synthetic fiber; a meta-aramid and para-aramid fiber blend; a meta-aramid, para-aramid, and modacrylic fiber blend; an oxidized polyacrylonitrile and aramid fiber blend; a flame-resistant leather; or a combination thereof, and the third flame resistant material comprises a second cotton fabric impregnated with a flame retardant chemical; a second cotton and high tenacity nylon fabric blend impregnated with a flame retardant chemical; or a combination thereof.

6. The garment of claim 4, wherein the upper attachment area comprises a shoulder attachment region and the protective garment is secured to the shoulder attachment region.

7. The garment of claim 4, comprising another protective garment comprising a fourth flame-resistant material, wherein the other protective garment is configured to be removably attached to the welding jacket at the upper attachment area, or the lower attachment area, or both.

8. The garment of claim 1, wherein the fastening mechanism is configured to be removably attached at a plurality of mounting positions at different heights to place the protective layer of clothing at the different heights over different areas of the welding jacket and the torso of the wearer.

9. The garment of claim 8, wherein the fastening mechanism comprises a common pattern of fasteners that corresponds with a mating pattern of fasteners at each of the plurality of mounting positions at the different heights.

10. The garment of claim 4, wherein the upper attachment area comprises an upper row of fasteners covered by a first portion of the first flame-resistant material, the lower attachment area comprises a lower row of fasteners covered by a second portion the second flame-resistant material, and the protective garment comprises a mating row of fasteners, wherein the upper, lower, and mating rows of fasteners have a common pattern.

11. The garment of claim 10, wherein the common pattern is configured to provide modularity in the layering of flame-resistant materials.

12. The garment of claim 1, wherein the protective layer of clothing comprises a bib configured to wrap around the welding jacket.

13. The garment of claim 12, wherein the protective layer of clothing comprises two or more fastening mechanisms configured to be removably attached to mid-back attachment locations on the welding jacket.

14. The garment of claim 1, wherein the different positions comprise first and second mutually exclusive fastening positions that are offset from one another, the different portions comprise first and second portions of the welding jacket corresponding to the first and second mutually exclusive fastening positions, the first and second portions comprise a common portion of the welding jacket, and the first portion comprises at least one portion of the welding jacket that is not common to the second portion.

15. The garment of claim 2, wherein a portion of the second flame-resistant material of the welding jacket covers the fastening mechanism.

* * * * *